United States Patent [19]

Nakasone et al.

[11] Patent Number: 4,492,601

[45] Date of Patent: Jan. 8, 1985

[54] PROCESS FOR CLARIFYING AND DESALINATING SUGAR CANE SYRUP OR MOLASSES

[75] Inventors: Seiken Nakasone; Sadao Miyagi, both of Okinawa; Takehiko Aragaki, Itoman; Yasusi Higa, Naha, all of Japan

[73] Assignees: Daiichi Seito Kabushiki Kaisha, Okinawa; Taito Kabushiki Kaisha, Tokyo, both of Japan

[21] Appl. No.: 434,484

[22] Filed: Oct. 15, 1982

[51] Int. Cl.[3] ..... C13D 3/02; C13D 3/16

[52] U.S. Cl. ..... 127/48; 127/46.2; 127/54; 204/180 P

[58] Field of Search ..... 127/48, 50, 51, 52, 127/54, 46.2; 204/180 P

[56] References Cited

U.S. PATENT DOCUMENTS

| | | | |
|---|---|---|---|
| 154,722 | 9/1874 | Soule | 127/48 |
| 601,305 | 3/1898 | Manoury | 127/50 X |
| 1,989,156 | 1/1935 | Sanchez | 127/48 |
| 2,350,143 | 5/1944 | Barber et al. | 127/50 |
| 3,290,173 | 12/1966 | Marino | 204/180 P X |
| 3,666,647 | 5/1972 | Kubo | 204/180 P |
| 3,677,818 | 7/1972 | Casebier et al. | 127/46 |
| 4,196,017 | 4/1980 | Melville et al. | 127/48 X |

FOREIGN PATENT DOCUMENTS

| | | | |
|---|---|---|---|
| 57-174100 | 10/1982 | Japan | 127/48 |

*Primary Examiner*—Kenneth M. Schor
*Attorney, Agent, or Firm*—William J. Daniel

[57] ABSTRACT

Inorganic oxy-acid and organic acid impurities are removed from raw cane sugar or molasses solutions by the steps of (1) admixing with the raw cane sugar syrup or molasses solution a water-soluble chloride of an alkaline earth metal ion which reacts with inorganic oxy-acid anions and radicals and with organic acids to form a water-insoluble precipitate of said oxy-acid anions and radicals and organic acids, (2) separating said precipitate from said solution while maintaining the Brix degree of the solution between more than 60% and less than 80%, (3) diluting the precipitate-free solution to a Brix of less than 55%, and (4) subjecting said diluted solution to an electrodialysis using cation exchange film and neutral film arranged in an alternating manner.

3 Claims, No Drawings

PROCESS FOR CLARIFYING AND DESALINATING SUGAR CANE SYRUP OR MOLASSES

The present invention relates to a process for clarifying and desalinating cane sugar syrup or molasses characterized by the steps of adding calcium chlorides, polyaluminium chlorides, etc. to a cane sugar syrup or molasses having high contents of calcium sulfate, silicate, etc. to deliberately form insoluble calcium and aluminium salts, treating the reaction mixture at a Brix degree of more than 60% and less than 80%, separating and removing the inorganic anions or organic acids at a concentration of less than 55% to reduce said contents and further subjecting the reaction mixture to a TD method electrodialysis.

Conventionally, manufacturing of cane sugar normally yielded about 3% of exhaust molasses as per the raw material. This is quite high as compared with the beet sugar manufacturing where exhaust molasses amounted to about 1% and there were even factories where no exhaust molasses was produced. Thus, it can be said that the cane sugar factory suffered from loss of sugar (sucrose+reducing sugar) in the form of exhaust molasses at least three times as high as that of the beet sugar factory.

Various reasons account for this difference in exhaust molasses yield: the main reason is that high concentration of reducing sugar in sugar cane makes it difficult to apply carbonation, an excellent clarifying method, whereas with sugar beet that content is small enough to allow the use of this method. Further, the ion exchange method (cold desalination method) is applicable in the beet sugar factory. Various appropriate measures such as the melibiase method have also been found to cope with the problems arising from the presence of raffinose which is one of the components peculiar to sugar beet. The clarifying method presently employed in the beet sugar factory is not suitable for the cane sugar factory because of the difference in composition and because the cane sugar is produced in mild climate. Moreover, although it is possible to employ ultrafiltration and the like, it would be too costly unless production of plantation white sugar is sought. Various methods have therefore been studied to decrease exhaust molasses to a level comparable to that of sugar beet. Exhaust molasses of the cane sugar factory has long been in the use in various fields as the raw material for fermentation and as a feed because of its low price and methods for clarifying the exhaust molasses of the cane sugar factory are also diversified.

However, these conventional clarifying methods are in most cases applied after diluting the molasses. This perhaps is suitable for the fermentation industry and the like, where diluting/clarifying liquid can be reused as it is. On the other hand, if the liquid is concentrated to a desired concentration for boiling in a vacuum pan, it would require too much fuel cost if the liquid is high diluted. Such clarifying methods as conventionally employed in the fermentation industry are therefore not advantageous in the cane sugar factory.

Electrodialysis is well known as a method for desalinating cane sugar syrup or molasses of a relatively high concentration and is presently employed in laboratories, salt manufacturing, dairy factories and the like. In case of sugar syrup or molasses, however, it is defective in that organic non-sugar contents would adhere to and precipitate on the anion exchange film and make regeneration difficult. In order to remove such organic contaminants, pretreatments such as ultrafiltration, decolorization with the use of active carbon, use of ion exchange resin and the like have been proposed. These pretreatment procedures are quite expensive and cause various problems in raw cane sugar factories where no decolorization is required and where it is not equipped with sophisticated facilities for treating the waste water such as active sludge and the like. As a still another alternative, a method is known to improve the resistance of electrodialysis against organic contaminants by modifying the nature of anion exchange film, but it is not yet established how long this film can function in use. It is also known to desalinate by first lowering the pH with HCl before adjusting the pH again by using an ion exchange resin. This method is defective in that the sugar is easily invertible at a pH in the lower range, that the whole reaction process must be made acid-proof, and that a large amount of waste water from regeneration ion exchange resin is produced. It has therefore been proposed to use relatively inexpensive polyvinyl alcohol (PVA) film having better resistance against organic contaminants instead an anion exchange film. (T.D. Method, or Transporting Depletion Method)

As is described in Jap. Pat. Appln. Sho No. 44-053656, there are disclosed various pretreatment methods for a TD method electrodialysis using carbonation, phosphatation or combination of carbonatation and decolorization by resin. The higher the desalination ratio increases by these pretreatments, the more marked the decrease in the current efficiency becomes. When the desalination ratio exceeds 70%, the current efficiency becomes lower than 30%. A current efficiency lower than 35% would cause too high a cost in electricity even in the cane sugar factory where the overall electricity cost is relatively low, rendering the method unpractical. On the other hand, if the desalination ratio is retained below 60% to increase the current efficiency, the residual salts will naturally increase and the efficiency of the method in recovering sugar is lowered. Above all, the most difficult problem encountered in the TD method is that when sugar solution which has been treated by a conventional method is subjected to the TD method, the residual salts will inevitably include calcium sulfate, silicate, calcium salt and magnesium salt and the like in a greater proportion. Such residual salts will adhere to the tube of the evaporator as hard-to-remove scale during concentration for further treatment and require frequent washing of the evaporator. These are the reasons why the TD method has not been used in conventional clarifying process for sugar cane.

The present invention has been conceived with an aim to reduce the yield of exhaust molasses from the cane sugar manufacturing by taking advantage of the nature of the sugar cane that when the concentration is high, sulfates, e.g. potassium sulfate and calcium sulfate are likely to precipitate whereas when the solution is diluted to a lower concentration, other salts such as calcium salt and phosphate are more likely to precipitate. In other words, calcium sulfate and silicate, which are the main cause of scale that is difficult to remove and is formed during the clarifying process of sugar cane, are removed while the concentration is relatively high. As the concentration is lowered, inorganic salts such as potassium salt having higher molasses forming property are removed to reduce the yield of exhaust molasses. The process according to the present invention enables the TD electrodialysis to be employed in clarifying sugar cane for the first time.

The present invention comprises the following steps.

First, the invention, broadly speaking, is a process for clarifying and desalinating cane sugar syrup or molasses which is characterized in that cane sugar syrup or molasses is added and agitated with a chloride of calcium and/or barium and/or strontium: and the reaction mixture is treated to remove the thusformed insoluble salts while maintaining the Brix degree between more than 60% and less than 80%.

The present invention proposes, but is not limited to, the use of calcium chloride, barium chloride or strontium chloride, etc. as the chemicals to be added to the cane sugar syrup or molasses.

Better results can be obtained if the pH of the solution is adjusted between 6.5 and 7.5 by adding milk of lime to the cane sugar syrup or molasses at the stage before mixing. It is also possible to conduct the reaction by heating to about 70° C. if it is necessary, but these conditions are not requirements. Subsequently, insoluble substances formed are removed by means of a centrifugal separator and the like. Any type of separator may be used and the number of steps is not limited to only one but it is possible to use a conveyor type (decanter type) and a partition type arranged in a series of two stages. Any other suitable manner can also be employed.

An adaptation of the above general process is quite effective in removing the insoluble salts which cause scale that are difficult to remove, involves taking the product which has been pretreated according to the general process above and diluting the sugar solution to a Brix degree of less than 55%, then heating the diluted solution with or without the addition of chlorides of aluminum or powdered active carbon to precipitate any salts still remaining in the solution, subjecting the heated mixture to centrifugation or filtration and still further to TD electrodialysis.

This process is carried out by diluting the reaction mixture to lower the Brix degree to less than 55% after conducting the general process above at a higher Brix degree.

The present invention proposes, but is not limited to the use of such chemicals as poly-aluminium chloride and the like as the chemicals to be added in this adaptation. It is also possible to omit them. The treatment is conducted while heating. Different kinds of filtration can be used other than centrifugal separation because the Brix degree is low.

The overall desalination ratio of this process is not much different from that of prior art processes. The difference lies in that the present invention enables removal at higher efficiency of sulfates, silicates, CaO and the like that were heretofore difficult to remove and were the cause of scale that were difficult to remove.

When compared with the prior art, the present process not only reduces the yield of exhaust molasses but enables for the first time in the world the application of the TD method in the manufacture of the cane sugar. In other words, when sugar syrup or molasses pretreated according to the present invention is subjected to an electrodialysis, the current efficiency as well as efficiency in removing the salts can be greatly improved, whereby the TD method is made economical and practical.

As is described above, the TD electrodialysis is defective in that its current efficiency is relatively low although it can be made quite resistant against organic contaminants because of the use of a neutral film instead of an anion exchange film. Especially if the removal ratio of the salts in the cane sugar syrup or molasses is increased, the current efficiency will be reduced further.

The sugar syrup which is treated according to the present invention, however, will greatly improve the current efficiency in the TD electrodialysis, especially when the removal ratio of the salts is increased. The mechanism for this increase is not yet quite clear, but it is assumed that the process for clarifying cane sugar syrup or molasses according to the present invention increases the current efficiency in the TD electrodialysis, as is evident from the examples, because anion constituents in the syrup such as $SiO_2$, $SO_3$, $P_2O_5$ that are difficult to remove by the TD electrodialysis are replaced by chlorine ions which are more easily removed.

A sugar solution containing various inorganic ions was subjected to TD electrodialysis at a desalination ratio of about 70%, and the removal ratio for each constituent salt was studied. It was found that Cl, $NH_4^+$ showed very high removal ratio followed by $K^+$, $Ca^{+2}$, $Mg^{+2}$ whereas $SiO_2$, $SO_3$, $P_2O_5$, Al and the like showed extremely low removal ratios.

It is then understood from the foregoing that by replacing as many anions in the cane sugar syrup or molasses as possible by chlorine ions which are more easily removable by the electrodialysis, the current efficiency in the electrodialysis can be improved. Suppose 70% desalination is attempted with these anions which have been replaced by chlorine ions, the chlorine ions will be preferentially desalinated until the ratio reaches 70%, whereby a current efficiency as high as the theoretical value (50%) can be obtained.

By removing in advance $SiO_2$, $SO_3$, $P_2O_5$ which cause complications in the treatment, the present process can eliminate the cause for producing scale that is difficult to remove, and at the same time it enables the application of TD electrodialysis to clarifying of cane sugar syrup or molasses which has previously been difficult because of too much electricity consumption due to extremely low current efficiency.

The present invention will now be described by way of examples.

EXAMPLE 1

The B molasses from a cane sugar factory was collected in an amount of 6.5 l, to which 80 ml of milk of lime having Brix 20 was added to adjust the pH to 6.9. The mixture was heated to 70° C., mixed with 230 ml of 10% calcium chloride solution and agitated before left standing for 30 min. The mixture was diluted to Brix 70 with warm water in an amount to make of about 8 l. The reaction mixture was separated into 1.6 l portion thereafter and heated again to 50° C. before being subjected to centrifugal sedimentation separation in five portions using high speed centrifugal sedimentation apparatus for laboratory use for 15 min. at 4000 rpm, to obtain 0.9 l of sludge and 6.6 l of separated liquid.

The resultant separated liquid was again divided into four portions each containing 1.6 l, heated at 50° C. and subjected to centrifugal sedimentation separation using the above centrifugal apparatus for 10 min at 7000 rpm, to obtain 0.11 l of sludge and 6.2 l of separated liquid. Table 1 shows the result of analysis of the resultant high concentration liquid.

EXAMPLE 2

The separated liquid as obtained in Example 1 was diluted to Brix 50, admixed with 93 ml of 10% polyaluminium chloride (PAC) and heated to 60° C. The mixture was admixed again with 3 ppm of coagulant "ARONVIS-S" (trademark) and subjected to centrifugal sedimentation for 10 min at 7000 rpm, to obtain 0.025 l of sludge and 8.02 l of separated liquid.

The separated liquid obtained from the third phase of process was analyzed. The result is shown in Table 2.

For comparison of the removal ratio of each organic salts contained, Table 3 is given. Table 3 shows the result of analysis of a liquid obtained by first directly diluting the raw syrup to Brix 50 and subjecting the same to a centrifugal sedimentation separation for 10 min at 7000 rpm and finally subjecting to diatomaceous earth precoat filtering. Table 4 shows the result of analysis of the filtrate which was obtained by diluting the raw syrup to Brix 30 before subjecting the same to carbonatation and diatomaceous earth filtration. Likewise, the reaction mixture was diluted to Brix 65, admixed with phosphoric acid to adjust the pH to 4 before heated to 60° C. The mixture was further admixed with milk of lime to adjust the pH to 8.0 and subjected to centrifugal sedimentation separation. The resultant separated liquid was admixed with phosphoric acid to adjust the pH to 5.5 and again subjected to centrifugal sedimentation separation. The result is shown in Table 5.

As is evident from Tables 1, 2, 3, 4 and 5, the process according to the present invention shows higher removal ratios of CaO and anions such as $SO_3$, $SiO_2$, preventing inversion of sucrose and decomposition of reducing sugar despite the fact that its overall desalination ratio is not much different from the conventional processes. However, Cl shows a slight increase.

Table 4 shows that although the purity of the syrup is higher, the residual CaO is present in a larger amount as is ash, and this would require higher desalination in the subsequent steps.

As far as we can judge from these Tables, the process of the present invention as shown in Tables 1 and 2 seems to show no difference as compared with other processes except the higher removal of $SO_3$ and $SiO_2$. However, the respective product liquids will show a marked difference when subjected to the TD electrodialysis.

As shown in Table 6, the treated liquid obtained in Example 2 an increase in the current efficiency by more than 40% when subjected to TD electrodialysis.

The liquids in Tables 3 and 4 which had been treated with centrifugal sedimentation separation and diatomaceous earth filtration and with carbonatation and filtration were subjected to the TD electrodialysis respectively to obtain the result also shown in Table 6. The difference in the current efficiency was respectively given as $41.3-27.3=14$, or an increase by $14/27.3\times100=51.28\%$, and as $41.3-21.1=20.2$, or an increase by $20.2/21.1\times100=95.73\%$.

EXAMPLE 3

The B molasses from a cane sugar factory was collected in an amount of 8 l, to which 92 ml of milk of lime having Brix 20 was added to adjust the pH to 6.6. 283 ml of 10% calcium chloride solution was added, and the mixture was agitated and heated to 70° C. before left standing for 30 min. The mixture was diluted to Brix 70 and subjected to centrifugal sedimentation separation for 15 min at 4000 rpm, to obtain 1.1 l of sludge and 8.0 l of separated liquid. The separated liquid was subjected to the second centrifugal sedimentation separation for 10 min at 7000 rpm, to obtain still another 0.15 l of sludge and 7.6 l of separated liquid. The resultant liquid was diluted to Brix 50 and admixed with 114 ml of 10% PAC, and heated to 50° C. before being subjected to centrifugal sedimentation separation for 10 min at 7000 rpm, to obtain 0.033 l of sludge and a separated liquid. 10 l of the separated liquid was subjected to dialysis using an apparatus having 20 pairs of a film area of 2.88 $dm^2$ for 2.75 hours at a cell voltage of 1.8 V. Table 7(A) shows the result. As a control liquid, the same syrup was diluted to Brix 50 and 13.6 l of this dilute was heated to 70° C. and mixed with 10 ppm of a coagulant before subjecting the same to separation using a centrifugal sedimentation apparatus for 15 min at 4000 rpm, to obtain 0.06 l of sludge and 12 l of separated liquid. The resultant separated liquid was heated to 50° C., admixed with 5 ppm of coagulant and subjected to centrifugal sedimentation for 10 min at 7000 rpm, to obtain still another 0.025 l of sludge and 11.35 l of separated liquid. 10 l of the solution thus treated was electrodialyzed under the same conditions as in (A) to obtain the result shown in (B). The solution (A) treated according to the present invention was higher in desalination ratio by $66.18-63.60=2.58\%$ and in current efficiency by $43.55-34.01=9.54\%$. The solution is thus improved over (B) by 28.04%.

EXAMPLE 4

The B molasses from a cane sugar factory was collected in an amount of 8 l, to which 50 ml of milk of lime having Brix 20 was added to adjust the pH to 6.0. The mixture was added with 320 ml of 20% calcium chloride, agitated and heated to 70° C. before left standing for 30 min. The resultant liquid was diluted with 2.28 l of water to Brix 70 and subjected to centrifugal sedimentation separation for 15 min at 4000 rpm, to obtain 0.8 l of sludge and 8.2 l of separated liquid. The separated liquid was further heated to 50° C. and subjected to a second centrifugal sedimentation separation for 10 min at 7000 rpm, to obtain 0.36 l of sludge and 7.2 l of separated liquid. The resultant separated liquid was diluted to Brix 50 and heated to 50° C. without the addition of PAC. It was admixed with 5 ppm of a coagulant and subjected to centrifugal sedimentation separation for 10 min at 7000 rpm, to obtain 0.025 l of sludge and 10.6 l of separated liquid. 10 l of said liquid was collected and dialyzed for 2.75 hours at a cell voltage of 1.8 V using an electrodialysis apparatus having 2.88 $dm^2$ in effective film area with 20 cells. Table 8 shows the result. When compared with the case where PAC was used, both the desalination ratio and current efficiency show slight decreases, but the sequence of this example proved to be more advantageous when the cost of chemicals is considered.

TABLE 1

Analysis of Untreated and Treated Syrups - using present invention high concentration solution: Desalination Ratio

| | Bx | Purity | pH | Stammer Color Value | Reducing Sugar (%) | CaO (%) | MgO (%) | $K_2O$ (%) | Cl (%) | $SO_3$ (%) | $SiO_2$ (%) | $P_2O_5$ (%) | $CO_2$ (%) | Sulfate Ash (%) |
|---|---|---|---|---|---|---|---|---|---|---|---|---|---|---|
| Raw Syrup (B Molasses) | 85.00 | 49.76 | 6.10 | 717 | 7.78 | 0.62 | 0.62 | 5.72 | 3.08 | 2.42 | 0.56 | 0.20 | 1.11 | 13.23 |
| | Calculated in 100 Bx | | | | 9.15 | 0.73 | 0.73 | 6.73 | 3.62 | 2.85 | 0.66 | 0.23 | 1.31 | 15.56 |
| Treated Syrup | 68.80 | 51.33 | 6.95 | 696 | 6.27 | 0.15 | 0.51 | 3.85 | 2.70 | 0.49 | 0.21 | 0.12 | — | 8.15 |
| | Calculated in 100 Bx | | | | 9.12 | 0.21 | 0.73 | 5.60 | 3.93 | 0.71 | 0.31 | 0.17 | — | 11.85 |
| Difference | | 1.57 | 0.85 | 21 | 0.03 | | | | | | | | | |
| Desalination Ratio (%) | | | | | | 70.82 | — | 16.79 | $\overset{\Delta}{8}$.56 | 75.09 | 53.03 | 26.09 | — | 23.84 |

TABLE 2

Analysis of Untreated and Treated Syrups - using present invention low concentration solution: Desalination Ratio

| | Bx | Purity | pH | Stammer Color Value | Reducing Sugar (%) | CaO (%) | MgO (%) | $K_2O$ (%) | Cl (%) | $SO_3$ (%) | $SiO_2$ (%) | $P_2O_5$ (%) | $CO_2$ (%) | Sulfate Ash (%) |
|---|---|---|---|---|---|---|---|---|---|---|---|---|---|---|
| Raw Syrup (B Molasses) | 85.00 | 49.76 | 6.10 | 717 | 7.78 | 0.62 | 0.62 | 5.72 | 3.08 | 2.42 | 0.56 | 0.20 | 1.11 | 13.23 |
| | Calculated in 100 Bx | | | | 9.15 | 0.73 | 0.73 | 6.73 | 3.62 | 2.85 | 0.66 | 0.23 | 1.31 | 15.56 |
| Treated Syrup | 48.85 | 51.88 | 6.50 | 758 | 4.52 | 0.07 | 0.37 | 2.77 | 2.03 | 0.35 | 0.18 | 0.08 | 0.08 | 6.18 |
| | Calculated in 100 Bx | | | | 9.26 | 0.15 | 0.71 | 5.67 | 4.16 | 0.71 | 0.36 | 0.17 | 0.17 | 12.66 |
| Difference | | 2.12 | 0.40 | $\overset{\Delta}{4}$1 | 0.11 | | | | | | | | | |
| Desalination Ratio (%) | | | | | | 81.02 | 2.74 | 15.75 | $\overset{\Delta}{1}$4.92 | 75.09 | 45.45 | 26.09 | 87.02 | 18.64 |

TABLE 3

Analysis of Untreated and Treated B Molasses (Brix 50) - using centrifugal separation and diatomaceous earth filtration: Desalination Ratio

| | Bx | Purity | pH | Stammer Color Value | Reducing Sugar (%) | CaO (%) | MgO (%) | $K_2O$ (%) | Cl (%) | $SO_3$ (%) | $SiO_2$ (%) | $P_2O_5$ (%) | $CO_2$ (%) | Sulfate Ash (%) |
|---|---|---|---|---|---|---|---|---|---|---|---|---|---|---|
| Raw Syrup (B Molasses) | 85.15 | 50.09 | 6.10 | 625 | 8.39 | 0.62 | 0.62 | 5.49 | 3.11 | 2.72 | 0.43 | 0.20 | 1.11 | 12.86 |
| | Calculated in 100 Bx | | | | 9.85 | 0.73 | 0.73 | 6.45 | 3.65 | 3.19 | 0.50 | 0.23 | 1.30 | 15.10 |
| Treated Syrup | 50.15 | 51.23 | 5.60 | — | 5.63 | 0.07 | 0.36 | 2.84 | — | 0.71 | 0.44 | — | — | 6.16 |
| | Calculated in 100 Bx | | | | 11.20 | 0.15 | 0.72 | 5.67 | — | 1.41 | 0.87 | — | — | 12.28 |
| Difference | — | 1.14 | $\overset{\Delta}{0}$.50 | — | $\overset{\Delta}{1}$.35 | | | | | | | | | |
| Desalination Ratio (%) | | | | | | 79.73 | 1.64 | 12.07 | — | 55.80 | $\overset{\Delta}{7}$4.00 | — | — | 13.68 |

TABLE 4

Analysis of Untreated and Treated C Molasses (Brix 30) using carbonation, centrifugal separation, phosphoric acid solution and diatomaceous earth filtration: Desalination Ratio

| | Bx | Purity | pH | Stammer Color Value | Reducing Sugar (%) | CaO (%) | MgO (%) | $K_2O$ (%) | Cl (%) | $SO_3$ (%) | $SiO_2$ (%) | $P_2O_5$ (%) | $CO_2$ (%) | Sulfate Ash (%) |
|---|---|---|---|---|---|---|---|---|---|---|---|---|---|---|
| Raw Sugar (C Molasses) | 82.56 | 30.73 | 5.00 | 2336 | 10.47 | 0.72 | 0.78 | 6.38 | — | — | 0.49 | 1.31 | — | 15.06 |
| | Calculated in 100 Bx | | | | 12.66 | 0.87 | 0.94 | 7.70 | — | — | 0.59 | 1.58 | — | 18.17 |
| Treated Syrup | 20.55 | 38.71 | 7.40 | 14.09 | 0.92 | 0.39 | 0.19 | 1.46 | — | — | 0.04 | 0.01 | — | 4.28 |
| | Calculated in 100 Bx | | | | 4.49 | 1.90 | 0.93 | 7.10 | — | — | 0.19 | 0.09 | — | 20.52 |
| Difference | | 7.98 | 2.4 | 927 | 8.17 | | | | | | | | | |
| Desalination Ratio (%) | | | | | | $\overset{\Delta}{1}$18.4 | 1.06 | 7.79 | — | — | 67.80 | 97.47 | | $\overset{\Delta}{1}$9.58 |

TABLE 5

Analysis of Untreated and Treated C Molasses - using phosphoric acid

| | Bx | Purity | pH | Stammer Color Value | Reducing Sugar (%) | CaO (%) | MgO (%) | $K_2O$ (%) | Cl (%) | $SO_3$ (%) | $SiO_2$ (%) | $P_2O_5$ (%) | $CO_2$ (%) | Sulfate Ash (%) |
|---|---|---|---|---|---|---|---|---|---|---|---|---|---|---|
| Raw Sugar (C Molasses) | 84.00 | 35.66 | 5.45 | 3,023 | 7.64 | 0.25 | 0.74 | 6.64 | — | — | — | — | — | 16.94 |
| | Calculated in 100 Bx | | | | 9.09 | 0.30 | 0.88 | 7.70 | — | — | — | — | — | 20.17 |
| Treated Syrup | 34.30 | 39.40 | 7.25 | 2,027 | 3.75 | 0.20 | 0.16 | 2.56 | — | — | — | — | — | 5.62 |
| | Calculated in 100 Bx | | | | 10.93 | 0.58 | 0.47 | 7.46 | — | — | — | — | — | 16.39 |
| Difference | | 3.74 | 1.80 | 996 | 1.84 | | | | | | | | | |
| Desalination Ratio (%) | | | | | | Δ 93.33 | 46.59 | 5.57 | — | — | — | — | — | 18.74 |

TABLE 6

Results of TD Electrodialysis of Syrups Treated with Present Invention Solution; Centrifugal Separation and Diatomaceous Earth Filtration; Carbonation and Filtration (B molasses is used in carbonation treatment)

| | Desalination ratio % | Current efficiency | Current density Amp/dm² | Start / End | Treated volume l | Bx | Purity | pH |
|---|---|---|---|---|---|---|---|---|
| Raw syrup (B molasses) | — | — | — | — | — | 85.10 | 49.76 | 6.10 |
| Treated syrup by the Invention (B molasses) | 69.63 | 41.30 | 3.01 (cell v. 1.8 V) | Start | 8.00 | 48.85 | 51.88 | 6.50 |
| | | | | End | 7.66 | 44.00 | 60.69 | 6.60 |
| Difference or elimination ratio | | | | | Δ 0.34 | Δ 4.85 | 8.81 | 0.10 |
| Centrifugal sedimentation & diatomaceous earth filtrated syrup (B molasses) | 68.62 | 27.32 | 5.48 (cell V. 1.8 V) | Start | 10.00 | 50.15 | 51.23 | 5.55 |
| | | | | End | 10.53 | 42.65 | 58.53 | 5.70 |
| Difference or elimination ratio | | | | | 0.53 | Δ 7.50 | 7.30 | 0.15 |
| Carbonation treated syrup | 76.15 | 21.12 | 6.48 (cell V. 2.0 V) | Start | 8.20 | 36.90 | 43.25 | 8.55 |
| | | | | End | 8.34 | 27.55 | 58.36 | 8.55 |
| Difference or elimination ratio | | | | | 0.14 | Δ 9.35 | 15.11 | 0 |

| | % 100 Bx | | | | | | | | |
|---|---|---|---|---|---|---|---|---|---|
| | R.S.* | CaO | MgO | $K_2O$ | Cl | $SO_3$ | $SiO_2$ | $Al_2O_3$ | Sulfate ash |
| Raw syrup (B molasses) | 9.15 | 0.67 | 0.66 | 6.75 | 3.62 | 2.85 | 0.66 | 0.14 | 15.56 |
| Treated syrup by the Invention (B molasses) | 9.26 | 0.15 | 0.66 | 5.67 | 4.16 | 0.73 | 0.36 | 0.25 | 12.66 |
| | 9.21 | 0.06 | 0.27 | 1.66 | 0.25 | 0.55 | 0.50 | 0.29 | 4.47 |
| Difference or elimination ratio | 0.05 | 62.25 | 58.48 | 70.72 | 93.99 | 24.66 | Δ 38.89 | Δ 16.00 | 64.89 |
| Centrifugal sedimentation & diatomaceous earth filtrated syrup (B molasses) | 11.20 | 0.07 | — | — | — | 1.14 | 0.87 | — | 12.28 |
| | 12.44 | 0.03 | — | — | — | 0.77 | 1.61 | — | 4.57 |
| Difference or elimination ratio | Δ 1.24 | 59.46 | — | — | — | 32.46 | Δ 85.06 | — | 62.79 |
| Carbonation treated syrup | 7.83 | 1.07 | 0.54 | 6.07 | — | — | — | — | 18.48 |
| | 9.26 | 0.31 | 0.16 | 0.87 | — | — | — | — | 4.50 |
| Difference or elimination ratio | Δ 1.43 | 71.03 | 70.37 | 85.67 | — | — | — | — | 75.65 |

*R.S.: Reducing sugar

TABLE 7

Results of TD Electrodialysis under Identical Conditions: Syrups treated with the Present Invention Solution and Addition of CaO & $CaCl_2$

| | Desalination ratio % | Current efficiency % | Current density Amp/dm² | Start / End | Treated volume l | Bx | Purity | pH | % 100 Bx CaO | MgO | $K_2O$ | Cl | $SiO_2$ | $SO_3$ | $P_2O_5$ | $CO_2$ | Sulfate ash |
|---|---|---|---|---|---|---|---|---|---|---|---|---|---|---|---|---|---|
| (A) | 66.18 | 43.55 | 3.04 | Start | 10.0 | 51.35 | 51.70 | 6.35 | 0.19 | 0.74 | 5.47 | 3.99 | 0.41 | 0.69 | 0.18 | 0.19 | 12.42 |

TABLE 7-continued

Results of TD Electrodialysis under Identical Conditions: Syrups treated with the Present Invention Solution and Addition of CaO & $CaCl_2$

| | Desalination ratio % | Current efficiency % | Current density Amp/dm² | Start / End | Treated volume l | Bx | Purity | pH | % 100 Bx CaO | MgO | $K_2O$ | Cl | $SiO_2$ | $SO_3$ | $P_2O_5$ | $CO_2$ | Sulfate ash |
|---|---|---|---|---|---|---|---|---|---|---|---|---|---|---|---|---|---|
| Treated syrup by the Invention (B molasses) | | | | End | 9.76 | 46.85 | 59.01 | 6.35 | 0.06 | 0.33 | 1.59 | 0.15 | 0.33 | 0.41 | 0.19 | 0.14 | 4.73 |
| Difference or elimination ratio | — | — | — | — | Δ0.24 | Δ4.5 | 7.31 | 0 | 68.42 | 55.41 | 70.93 | 96.24 | 19.51 | 40.58 | Δ5.56 | 27.78 | 61.92 |
| (B) | 63.60 | 34.01 | 3.07 | Start | 10.0 | 50.45 | 52.66 | 6.40 | 0.22 | 0.72 | 5.98 | 3.65 | 0.44 | 1.22 | 0.21 | — | 12.78 |
| Control syrup added with CaO & $CaCl_2$ | | | | End | 9.76 | 46.45 | 58.45 | 6.40 | 0.13 | 0.42 | 2.01 | 0.19 | 0.41 | 1.00 | 0.18 | — | 5.19 |
| Difference or elimination ratio | — | — | — | — | Δ0.24 | Δ4.0 | 5.79 | 0 | 41.74 | 42.40 | 66.39 | 94.79 | 6.82 | 18.03 | 14.27 | — | 59.37 |
| (A) − (B) | 2.58 | 9.54 | 0.03 | — | 0 | 0.5 | 1.52 | 0 | 26.68 | 12.95 | 4.54 | 1.45 | 12.69 | 22.55 | Δ19.85 | — | 2.53 |

(Refer to Example 3)

TABLE 8

Results of Electrodialysis of Syrup Treated without using PAC

| | Desalination ratio % | Current efficiency % | Current density Amp/dm² | Start / End | Treated volume l | Bx | Purity | pH | % 100 Bx R.S.* | CaO | MgO | $K_2O$ | Cl | $SiO_2$ | $SO_3$ | Sulfate ash | Oxalic acid |
|---|---|---|---|---|---|---|---|---|---|---|---|---|---|---|---|---|---|
| Treated syrup | 62.09 | 42.20 | 2.61 | Start | 10.0 | 50.20 | 52.93 | 6.0 | 11.88 | 0.35 | 0.73 | 5.41 | 3.94 | 0.39 | 0.63 | 12.73 | 0.006 |
| by the Invention without addition of PAC | | | | End | 10.0 | 45.20 | 60.13 | 5.6 | 10.55 | 0.18 | 0.44 | 1.41 | 0.15 | 0.34 | 0.67 | 4.57 | 0.003 |
| Difference or elimination ratio | — | — | — | — | 0 | Δ5.00 | 7.20 | Δ0.4 | 1.33 | 48.57 | 39.73 | 73.94 | 96.19 | 12.82 | Δ6.3 | 64.10 | 50.00 |

(*R.S.: Reducing Sugar)

What we claim is:

1. A process for clarifying and desalinating raw cane sugar syrup or molasses solutions containing inorganic oxy-acid and organic acid impurities therein, which comprises the steps of (1) admixing with the raw cane sugar syrup or molasses solution a water-soluble chloride of an alkaline earth metal ion which reacts with inorganic oxy-acid anions and radicals and with organic acids to form a water-insoluble precipitate of said oxy-acid anions and radicals and organic acids, (2) separating said precipitate from said solution while maintaining the Brix degree of the solution between more than 60% and less than 80%, (3) diluting the precipitate-free solution to a Brix of less than 55%, and (4) subjecting said diluted solution to an electrodialysis using cation exchange film and neutral film arranged in an alternating manner.

2. The process of claim 1 wherein said diluted solution before being subjected to electrodialysis is heated, treated with an additional amount of one of said water-soluble chlorides to precipitate any unremoved impurities, and any resultant precipitate is separated.

3. The process of claim 1 wherein said diluted solution before being subjected to electrodialysis is heated, treated with a finely divided absorbent for organic impurities and said absorbent is separated.

* * * * *